US005921654A

United States Patent [19]

Coyle

[11] Patent Number: 5,921,654

[45] Date of Patent: Jul. 13, 1999

[54] ILLUMINATED MANUAL GRIPPING DEVICE

[76] Inventor: Timothy Coyle, P.O. Box 3031, Reno, Nev. 89505-3031

[21] Appl. No.: 08/840,220

[22] Filed: Apr. 11, 1997

[51] Int. Cl.[6] ..... B25B 23/18

[52] U.S. Cl. ..... 362/120; 362/119

[58] Field of Search ..... 362/109, 119, 362/120, 396, 577, 578

[56] References Cited

U.S. PATENT DOCUMENTS

| | | | |
|---|---|---|---|
| 2,034,913 | 3/1936 | Kros | 362/396 |
| 2,176,479 | 10/1939 | Willis | 362/120 |
| 2,854,564 | 9/1958 | Cohen et al. | 362/119 |
| 5,371,658 | 12/1994 | Christie | 362/119 |
| 5,420,767 | 5/1995 | Jones | 362/109 |
| 5,647,622 | 7/1997 | Schectman | 294/19.1 |

*Primary Examiner*—Alan Cariaso

*Attorney, Agent, or Firm*—Skinner, Sutton & Watson; Charles L. Hartman

[57] ABSTRACT

A manual gripping tool with an illuminated gripping end allows the user to find and manipulate small objects in close, dark environments. An illumination source on the gripping end of the tool illuminates objects in the close environment, allowing the user to see the desired object for manipulation. One preferred use is to recover lost objects that might have fallen or otherwise become lodged in the close environment.

10 Claims, 2 Drawing Sheets

ILLUMINATED MANUAL GRIPPING DEVICE

BACKGROUND OF THE INVENTION

1. Field of the Invention

This invention relates to manually operated apparatus to grip, retrieve and manipulate small objects, more particularly this invention relates to manually operated apparatus having an illumination source, and in particular, this invention relates to pliers having a source of illumination mounted thereon.

2. Background of the Invention

Pliers and similar gripping tools have been used for years to hold objects and pick them up. Usually a workman uses them in a well lighted work area, but occasionally, one needs to hold or retrieve an object in a dimly lit, close environment. Such environments include under the hood of an automobile, in the mainframe bodies of computers, in plumbing, where access the the interior of such equipment as garbage disposals may be limited, and even in the case of access to the pharyngal region of a choking victim. Usually, the solution for such confined places is an attempt to hold a flashlight or similar illuminating device, either with a free hand or by placing it under a chin, or some other similar awkward method, to illuminate the dark region by aiming the cone of illumination down to the work piece or area where the pliers need to be used. This results in the awkward use of the light while trying to avoid casting a shadow of the hand holding the pliers down the restricted area. Not infrequently, this can't be done and the user must grope with the pliers in the dark confined space to accomplish his goal.

Various solutions for solving the problem of inadequate illumination at the work piece have been tried. U.S. Pat. No. 5,420,767, issued to Jones, shows a clamp having an illuminated jaw. It is clamped near the area needing illumination. The light created fans outwardly from each jaw, illuminating difficult to reach areas. The thick jaws of the clamp make access into confined environments difficult nor can the clamp be conveniently used for picking up or otherwise manipulating objects.

Another approach is exemplified by the screwdriver of U.S. Pat. No. 4,768,137, issued to Hwaw, which teaches that a flashlight may be mounted inside the handle of a screwdriver.

There is a need for a device that allows the illumination of close areas for use with pliers.

SUMMARY OF THE INVENTION

This invention provides a manual gripping tool with an illuminated gripping end allows the user to find and manipulate small objects in close, dark environments. An illumination source on the gripping end of the tool illuminates objects in the close environment, allowing the user to see the desired object for manipulation. One preferred use is to recover lost objects that might have fallen or otherwise become lodged in the close environment.

A first aspect of this invention is a manual gripping tool having a first gripping finger, and a second gripping finger, disposed in pivotable relationship to the first gripping finger about a pivot point and contactable with the first gripping finger. A source of illumination mounted on the first gripping finger provides lighting at the tip of the tool allowing the user to see where the tip of the tool is in tight confided places and to see any objects nearby the tip of the tool. A manually engageable means movings the first gripping finger into contact with the second gripping finger to perform work in the tight confined environment or to retrieve objects from the tight environment.

A second aspect of this invention is an illuminated tip pliers having a first gripping finger extending from a first handle for a users grasp and a second gripping finger extending from a second handle for a users grasp, disposed in pivotable relationship to the first gripping finger at a pivot point between the first gripping finger and the first handle and the second gripping finger and the second handle, the second gripping finger being contactable with the first gripping finger. An illumination source mounted on the second gripping finger casts a cone of illumination in front of the second gripping finger when illuminated. A power source to illuminate the illumination source provides power transferred to the illumination source by a means to transfer power from the source running from the source of power to the illumination source. The handles provide a manually engageable means for moving the first gripping finger into contact with the second gripping finger.

DETAILED DESCRIPTION OF THE PREFERRED EMBODIMENT

Figure 1:
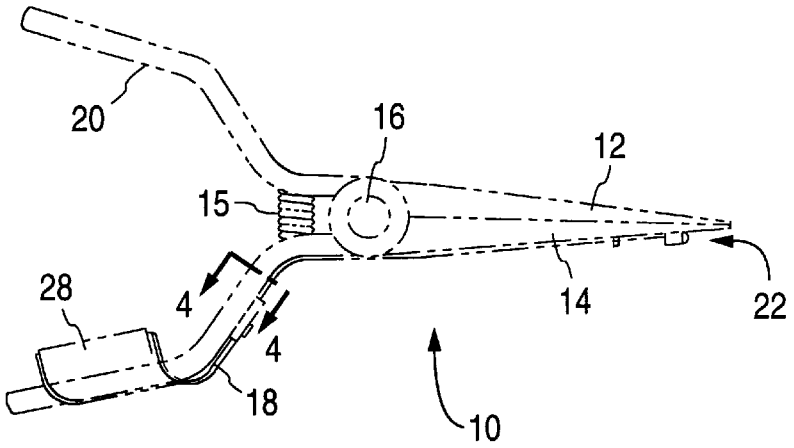
FIG. 1 shows an overall top view of the tool of this invention.

Referring to FIG. 1, in one embodiment, the tool of this invention provides a plier-like tool 10. The tool has a first gripping finger 12 and a second gripping finger 14. The two fingers are disposed in pivotable relationship with each other, about a pivot point 16 so that the second gripping finger may contact the first gripping finger, as shown in the drawing. The means for moving the fingers in relation to each other is a first extension 18 of the first gripping finger 12 past the pivot point 16 to form a handle and an extension 20 of the second gripping finger 14 past the pivot point 16 to form a second handle. A spring biasing means 15, mounted on the handle side of the pivot point 16, urges the fingers outwardly and away from each other unless the hand of the user compresses the handles of the device together. The invention can, in this embodiment be viewed as pliers, but any other conventional means of connecting a manually manipulated finger moving device can be used. It is preferred that the fingers 12 and 14 be longer in relation to the handle than might ordinarily found in conventional needle nose pliers. The longer reach allows easy access to areas not normally reachable even by needle nose pliers, such as the bottom of a garbage disposal, or up a clogged pipe, or even into and obstructed airway of a choking victim.

Figure 2:
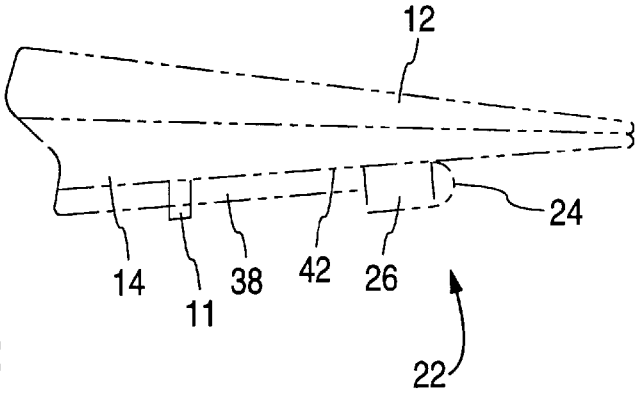
FIG. 2 shows a partial close up top view of the illumination source of the tool shown in FIG. 1.

Referring now to FIG. 2, an illumination source 22 mounted on the second gripping finger 14 provides light of the work area when the tool is in use. As shown the illumination source is a light bulb 24 in a bulb socket 26. The socket can be attached to the second finger by any conventional means, such as a clip, or adhesive means. In the practice of this invention, it is normally preferred to use a light bulb, to provide a wide cone of illumination. This is especially true when the primary intended use is for searching for lost objects, or objects lodged in tight places deep in a fairly wide area, such as in the interior of a garbage disposal and the like. But the illumination can be provided by a fiber-optic cable to provide a point source of light. It will be understood that, although in general operation, one source of illumination is satisfactory for use, a second source of illumination can be provided mounted on the first gripping finger tip, and powered as shown for the first source of illumination.

The wires 38 from the switch are mounted on the outside of the handle extension 40 and the outside of the jaw piece 42. The wires are secured by any conventional means, one preferred means being a series of pegs 44 that secure the wire to the outside of the jaw piece. If a second source of illumination is provided the wires to this second source of illumination will be guided by similar means.

Figure 3:
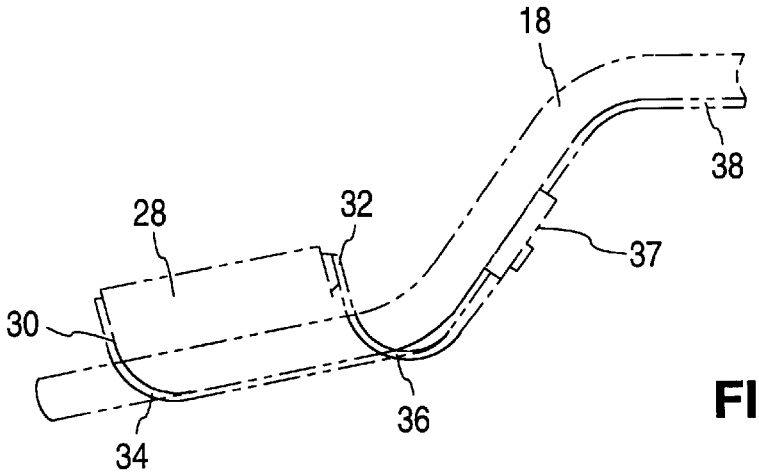
FIG. 3 shows a partial close up top view of the electric power source of the tool shown in FIG. 1.

Referring now to FIG. 3, the illumination source typically will need some sort of external source of energy to operate. One preferred source is a battery 28 mounted on the first extension 18. The battery is held in place by clamps or other means to secure it to the extension piece, and contacts a first contact 30 and a second contact 32. The first contact is in electric contact with a first wire 34 and the second contact is in electric contact with a second wire 36. The first wire 34 and the second wire 36 lead to a manually operable electric switch 38 mounted on the first extension. It is preferred that the electric switch 37 be thumb or finger operable by the same hand of the user that would normally hold the tool. The source of electric power can, of course be any conventional means to provide power, such as a battery pack that might be worn on the users belt. This way the electric demands of the particular job can be easily met.

Figure 4:
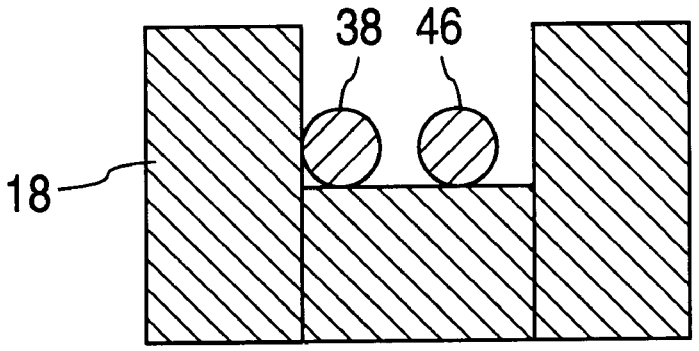
FIG. 4 shows a cut away view of FIG. 1 to show a detail of the handle of the tool shown in FIG. 1.

Referring now to FIG. 4, the handle of the tool 18 (as well as the fingers 12 and 14) may have a groove 46 machined into the surface of the handle 18. The wires 38 that extend from the switch to the illumination source are laid in the groove 46 to avoid having them in a position where they may snag objects in the close environment where the tool is used.

Figure 5:
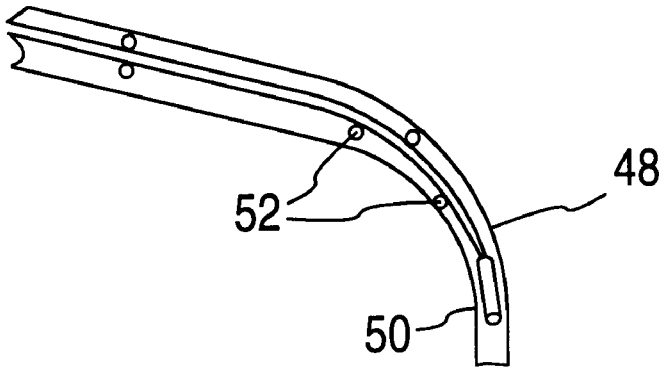
FIG. 5 shows an elevational view of an alternative embodiment of the gripping end of the tool shown in FIG. 1.

Some close environments are not easily accessible and need extra curves to allow the tool to reach. Referring to FIG. 5, the working end of the tool may be any desired shape to best perform the needed work. The curved tip 48 allows a user to place the tool in areas not reachable by a straight tool. The illumination source 50 casts a cone of illumination in front of the tip of the tool, allowing the user to see what the tip is near to contacting. The curved nose 48 of the tool allows it to fit into these tight places. Pegs 52 placed in the tip allow the wires 38 from the power source to be guided to the illumination source. Other modifications of the working end of the tool may be desired given the intended job for the tool. For example, teeth or similar grabbing means may be included on the inside of the fingers where they meet to allow a more positive grasp of the object being worked on. In another embodiment, the tip may include a sharpened end for cutting a work piece in a close environment. All tips ends conventionally used for pliers can be used for the tip in this invention.

The typical use for the invention might be in the situation where one has lost a tool in, for example, the engine compartment of a car, or some other close environment, such as the interior of a mainframe of a computer, or where a foreign object needs to be removed for proper operation of a moving machine, for example, a garbage disposal or the like. In use the tool of this invention is held in the hand of the user and the tip is placed into the close environment. The spring biasing means urges the gripping fingers apart. The user turns on the illumination means by moving the electric switch from the "off" position to the "on" position. The illumination means now provides a cone of light within the confines of the close environment allowing the user to see the area he is working on. If, for example the tool is being used to retrieve an object that is lodged in an in appropriate place, such as might be the case in a stuck garbage disposal, the cone of illumination shows where the offending object is located. The user allows the spring biasing means to urge the first gripping finger 12 and the second gripping finger 14 apart and the object is maneuvered between the fingers of the tool. The user then clamps down on the object with his hand, and removes the object.

In another similar use, chocking victims frequently have food items or the like lodged in their throats. The tool, preferable one made for the job and made from stainless steel or disposable plastic, is inserted down the victims throat. The light switch is turned on by the attending medical worker, usually a paramedic or the like, and the offending foriegn food particle or the like is fully revealed. The gripping fingers are placed around the illuminated offending object and the fingers are closed by the medical worker and the foriegn item is extracted from the victims throat.

Other uses can readily be envisioned for an illuminated tip tool. If a wire needs to be cut that is located in a close environment, the tool, fitted with a cutting end, can rapidly allow the user to find the wire and rapidly cut it. Or if a clamp or wire needs crimping, the tool can be used to access the clamp or wire and crimp it. Other convention tools can be modified according to the spirit of this invention, for example, locking pliers with illumination can be provided, as well as tools conventionally used for fishing for lost parts, which can also be provided with illumination.

Although this invention has been primarily described in terms of specific examples and embodiments thereof, it is evident that the foregoing description will suggest many alternatives, modifications, and variations to those of ordinary skill in the art. Accordingly, the appended claims are intended to embrace as being within the spirit and scope of invention, all such alternatives, modifications, and variations.

I claim:

1. Illuminated tip pliers comprising:

a first gripping finger extending from a first handle for a users grasp;

a second gripping finger extending from a second handle for a users grasp, disposed in pivotable relationship to the first gripping finger at a pivot point between the first gripping finger and the first handle and the second gripping finger and the second handle, the second gripping finger being contactable with the first gripping finger;

an illumination source mounted on the second gripping finger that, when illuminated, casts a cone of illumination in front of the second gripping finger;

a power source to illuminate the illumination source;

means to transfer power to the illumination source connected to the power source; and manually engageable means for moving the first gripping finger into contact with the second gripping finger.

2. The illuminated tip pliers of claim 1 wherein the pliers further include a second illumination source mounted on the first gripping finger, connected to the power source by means to transfer power, such that the second source of illumination casts a second cone of illumination in front of the first gripping finger.

3. The illuminated tip pliers of claim 1 wherein the pliers further comprise tips at the end of the first and second gripping finger distal from the manually engageable means and further comprise straight needle nose pliers having gripping fingers that are at least twice as long as the first handle and the second handle.

4. The illuminated tip pliers of claim 1 wherein the pliers further comprise tips at the end of the first and second gripping finger distal from the manually engageable means and further comprise curved first and second gripping fingers.

5. The illuminated tip pliers of claim 1 wherein the handle of the pliers has a machined groove to receive the means to transfer power from the source of power to the illumination source.

6. The illuminated tip pliers of claim 1 wherein the pliers further include a biasing means to urge the fingers apart.

7. The gripping tool of claim 1 wherein the illumination source is powered by an electric source.

8. The gripping tool of claim 7 wherein the electric source is a battery mounted on the extension of the first gripping finger.

9. The gripping tool of claim 7 wherein the power source is an external source connected to the tool by wiring.

10. The gripping tool of claim 7 wherein the source of illumination is an electric light bulb.

* * * * *